United States Patent [19]

Schick et al.

[11] 4,185,485

[45] Jan. 29, 1980

[54] LUBRICANT COMPOSITIONS FOR CAN FORMING

[75] Inventors: John W. Schick, Cherry Hill; Robert H. Davis, Pitman; Harry J. Andress, Wenonah, all of N.J.

[73] Assignee: Mobil Oil Corporation, New York, N.Y.

[21] Appl. No.: 921,019

[22] Filed: Jun. 30, 1978

[51] Int. Cl.[2] ..... C07C 69/40; C10M 3/04; C10M 3/18; C10M 3/26

[52] U.S. Cl. ..... 72/42; 252/42; 252/42.4; 252/49.3; 252/49.5; 252/51.5 A; 113/120 A; 560/196

[58] Field of Search ..... 252/42, 42.4, 49.3, 252/49.5, 51.5 A; 72/42; 113/120 A, 120 H; 560/196

[56] References Cited

U.S. PATENT DOCUMENTS

| | | | |
|---|---|---|---|
| 2,954,343 | 9/1960 | Pitman | 252/49.5 X |
| 3,170,898 | 2/1965 | Verdol | 560/196 |
| 3,311,557 | 3/1967 | Schlermeier et al. | 252/34 |
| 3,697,428 | 10/1972 | Meinhardt et al. | 252/56 D |
| 3,708,522 | 1/1973 | Le Suer | 560/196 |
| 4,053,426 | 10/1977 | Davis et al. | 252/51.5 A |

*Primary Examiner*—W. J. Shine

*Attorney, Agent, or Firm*—Charles A. Huggett; Raymond W. Barclay; Claude E. Setliff

[57] ABSTRACT

An emulsifiable concentrate for use in metal processing, especially in can forming, comprises an ester prepared from a polyalkenylsuccinic acid or anhydride, and a hydroxyl-containing amine. It is critical to the invention with respect to can forming that the acid or anhydride contain, in addition to its basic carbon length, a chain derived from an olefin having from 16 to 28 carbon atoms.

23 Claims, No Drawings

LUBRICANT COMPOSITIONS FOR CAN FORMING

BACKGROUND OF THE INVENTION

1. Field of the Invention

This invention relates to emulsifiable lubricants and particularly to oil-in-water emulsions thereof used in metal working, especially in aluminum can forming and metal cutting.

2. Description of the Prior Art

Modern can forming or other metal-working methods requiring lubricant emulsions use procedures that have severely tested present lubricants. It is known in the art, for instance, that can forming operations, i.e. cupping, drawing and ironing, require emulsions with special properties. However, no art is known which discloses or suggests the compositions provided by this invention.

U.S. Pat. No. 3,071,544 describes emulsions, primarily for rolling oils, containing components including a small amount of an organic acid which may be reacted with other components to provide oil soluble soaps, such as soaps of alkanolamines. U.S. Pat. No. 3,311,557 describes emulsions containing a fatty acid, a polyol and ethanolamine, which latter reacts with the acid to provide a ratio of base number to acid number of 0.15 to 0.4.

U.S. Pat. No. 3,697,428 is concerned with an oil soluble composition made by reacting, for example, a polyolefin-substituted succinic anhydride and di-or trihydric alcohol and a polyhydric alcohol containing at least four hydroxyl groups. U.S. Pat. No. 3,381,022 teaches ester derivatives of a hydrocarbon-substituted succinic acid, the hydrocarbon being an aliphatic chain containing at least 50 carbon atoms and a mono-or polyhydric alcohol, phenols and naphthols. They are useful as additives to hydrocarbon oils and lubricating compositions or fuels.

Both of U.S. Pat. No. 3,523,895 and U.S. Pat. No. 3,723,314, as well as U.S. Pat. No. 3,723,313, disclose an emulsifiable oil containing acid, triethanolamine and oil.

Of interest also are U.S. Pat. Nos. 2,588,412; 3,368,971; 3,448,049; 3,451,931; 3,458,444; and 3,676,483.

SUMMARY OF THE INVENTION

In accordance with the invention there is provided an emulsifiable composition comprising:

(a) the reaction product made by reacting an alkenylsuccinic anhydride or acid wherein the alkenyl is derived from a mixture of $C_{16}$–$C_{28}$ olefins with (1) a hydroxyl-containing tertiary amine containing 2 to 100 carbon atoms, or (2) a hydroxypoly-etheramine of the formula $$R-\underset{\underset{R'}{|}}{N}-(CH_2CH_2O)_xCH_2CH_2OH \quad \text{or}$$

$$\underset{\underset{R'}{|}}{R-N}-(CH_2CH_2CH_2O)_xCH_2CH_2CH_2OH$$

wherein R and R′ together are $C_8$ to $C_{18}$ hydrocarbyl groups and x is from 1 to 50; R′ may also be a polyether group from 1–50 moles of ethylene or propylene oxide, (b) the reaction product of (a) (2) plus a rosin soap; or (c) the product of (a) or (b) and from about 0.5% to about 15% by weight of a $C_2$ to $C_{10}$ monocarboxylic acid.

The invention also provides a method of working metals using such compositions.

DESCRIPTION OF SPECIFIC EMBODIMENTS

As has been stated, the lubricant emulsions used in this invention will broadly comprise from about 1% to about 50% by weight of the emulsifiable composition. Preferably,, the amount will be from about 3% to about 20% by weight in water.

Included among the hydroxyalkylamino compounds are trialkanolamine, wherein the alkane portion has from 2 to 100 carbon atoms. For example, these specifically include triethanolamine, triisopropanolamine, and the like. The preferred member is triethanolamine.

The monocarboxylic acids useful in this invention include the acetic, propionic, butyric, pentanoic, octanoic and decanoic acids.

We have found that, for effectiveness in can forming operations, it is critical that the R group attached to the succinic acid or anhydride be derived from a mixture of $C_{16}$–$C_{28}$ acids. The preferred olefin mixture is the bottoms from an olefin oligomerization and the mixture will have the following composition:

TABLE 1

| Ingredient | % by wt. | Other |
|---|---|---|
| Olefin (chain length) | | |
| $C_{16}$ | 2max. | |
| $C_{18}$ | 5–15 | |
| $C_{20}$ | 42–50 | |
| $C_{22}$ | 20–28 | |
| $C_{24}$ | 6–12 | |
| $C_{26}$ | 1–3 | |
| $C_{28}$ | 2 max. | |
| Alcohol | 10 max. | |
| Paraffin | 5 max. | |
| Iodidine NO. | | 74 min. |
| Peroxide | | 10 ppm max. |
| Olefin types by NMR | | |
| Vinyl | 28–44 | |
| Branched | 30–50 | |
| Internal | 26–42 | |

Because of the source of the olefin mixture, one does not always get the same product from successive batches, but each mixture used will have a composition falling within the ranges stated and will be equally effective for use in this invention. The olefin mixture is reacted with maleic anhydride or acid to give the polyolefin-substituted succinic compound at from about 150° C. to about 250° C.

The reaction of the acid with the hydroxyamine compounds (which term includes both the hydroxy alkylamines and the hydroxypolyetheramine types) can be carried out at from about 100° C. to about 300° C., preferably 150° C. to 250° C. and for a time sufficient to form the ester, usually about 3 hours to about 6 hours. The time and temperature of reaction are not critical and will obviously depend in some measure upon the reactants selected.

The addition of the rosin soap or monocarboxylic acid is done at room temperature or at moderately elevated temperatures, e.g. at from about 25° C. to about 50° C.

The preferred use for the compositions of the invention, and especially for the product made from the succinic acid and hydroxypolyetheramine with rosin soap added, is in metal can forming.

Having described the invention in general terms, the following are offered as specific illustrations. It will be understood that they are illustrative only and are not meant to limit the invention.

EXAMPLE 1

A mixture containing a 1:1 molar ratio of the above-described olefin mixture (mol. wt. 325) and of maleic anhydride was stirred while heating to 250° C. over a 2-hour period and was held at 250° for another 2 hours to give the $C_{16}$–$C_{28}$ alkenylsuccinic anhydride.

Five hundred grams of this product was mixed with 300 g. (2 moles) of triethanolamine and was stirred while heating to 260° C. over a 5 to 6 hour period.

EXAMPLE 2

A mixture of 500 g. of the succinic anhydride of Example 1 and 1000 g. (2 moles) of Ethomeen S-15 (a poly-oxyethylene soyamine made by hydrolyzing soybean oil, converting it to the acid, forming the $C_{16}$–$C_{18}$ primary amine and reacting with 5 moles of ethylene oxide) was stirred to about 260° C. over a 5 to 6 hour period to give the final product.

EVALUATION OF PRODUCTS

Aluminum can forming

The following compositions were tested:

TABLE 2

| Composition 1 wt % | | Composition 2 wt % | | Composition 3 wt % | |
|---|---|---|---|---|---|
| Example 1 product | 68 | Example 1 product | 68 | Example 2 product | 95 |
| Caprylic acid | 4 | Caprylic acid | 8 | Rosin acid salt* | 5 |
| 2-Ethyl-hexanoic acid | 4 | Tolu-triazole | 4 | | |
| Tolutria-zole | 4 | Polyglycol | 20 | | |
| Polyglycol | 20 | | | | |

*The potassium salt of rosin acid wherein the acid is mostly abietic acid.

Testing was performed as follows:

A sheet of aluminum 0.015 inch thick was coated with a lubricant containing 97% water and 3.0% of the above compositions and was fed to the cupper. The formed cups retain the 0.015 inch thickness on bottoms and sides. From here, the cups were fed to a body maker where they were formed into container having sides 0.005 inch thick and 0.015 inch bottoms. The formed cans were fed to a multistage washing unit where they were washed with a solution containing water, sulfuric acid, hydrofluoric acid and a surfactant. They were then washed with water and given a conversion coating. The table below summarizes the results.

TABLE 3

| Performance Test A | Composition 1 | Composition 2 | Composition 3 |
|---|---|---|---|
| Cupper (Minster single feed | Good Cup @ 3 % | Good cup @ 6 % | Good cup @ 6 % |
| Pick-up | Slight at 1.5 % | None | Slight at 3% |
| Body maker (bliss single feed | Good cans at 3 % | | Good cans at $3\frac{3}{4}$ % |
| Washer acid conversion | Water break Clean conversion | | Clean at 100° F. |

TABLE 3-continued

| Performance Test A | Composition 1 | Composition 2 | Composition 3 |
|---|---|---|---|
| coating | coating only | | |

With respect to composition 3, good cups were made at 6% concentration using 240 pounds hold-down pressure; 210 pounds hold-down pressure resulted in some wrinkles.

Again with respect to composition 3, approximately 150 cans were drawn and ironed at $3\frac{3}{4}$% using a 30 pounds blow-out pressure. The finish was good, with no observable bodymaker grease on the dies.

Tapping Efficiency Test

This test measures the effectiveness of a test composition in metal cutting fluids.

The data in Tables 4–6 were obtained by means of a Tapping Efficiency Test, and in general the procedure thereof involves measurement of torque developed in an internal threading operation employing SAE1020 or similar hot-rolled steel. In this test, thirty torque values are obtained with the test fluid and compared with thirty reference fluid values to obtain percent of tapping efficiency in accordance with the formula $$\% \text{ Tapping Efficiency} = \frac{\text{Avg. of 30 Reference Fluid Torque values} \times 100}{\text{Avg. of 30 Test Fluid Torque}}$$

The reference fluid (or blank) employed in the test shown following each table.

In general, the ability of a cutting oil to operate efficiently is measured by this test. In the test, a series of holes is drilled in a test metal such as SAE 1020 hot-rolled steel. The holes are tapped in a drill press equipped with a table which is free to rotate about the center on ball bearings. A torque arm is attached to this "floating table," and the arm in turn activates a spring scale, so that the actual torque during the tapping with the oil being evaluated is measured directly. The same condition used in evaluating the test oil are employed in tapping with a standard, which has arbitrarily been assigned an efficiency of 100%. The average torque in the test standard is compared with that of the standard and a relative efficiency is calculated on a percentage basis.

TABLE 4

| Emulsifiable Concentrate | | | | | |
|---|---|---|---|---|---|
| Percent Example 1 Product | Percent Acetic Acid | Percent Caprylic Acid | Percent 2-Ethyl-hexanoic Acid | % in $H_2O$ | Tapping Efficiency* |
| 90 | 10 | — | — | 3 | 238% |
| 90 | — | 10 | — | 3 | 472% |
| 90 | — | — | 10 | 3 | 292% |

*Mineral Oil mixed with sodium sulfonates at 3% in distilled water = 100%

TABLE 5

| Example 1 Product | 100 SUS SPN Mineral Oil | Tapping Efficiency* |
|---|---|---|
| — | 100 | 53% |
| 10 | 90 | 61% |

*Sulfurized mineral oil containing sulfurized fat and phosphosulfurized oxidized mineral oils = 100%.

TABLE 6

| Composition, % Wt. | | | Composition Tapping Test | | Hard water Stability |
|---|---|---|---|---|---|
| Example 2 Product | Example 1 Product | Potassium Rosin Soap | Dilution % Wt. in Dist. Water | Tapping Efficiency | (500 ppm as $CaCO_3$) 24 hrs. at 70° F. |
| 100 | — | — | 3 | 113% | Separation |
| 90 | — | 10 | 3 | 114% | No separation |
| — | — | — | 3 | 145% | Separation |
| — | — | 5 | 3 | 108% | No separation |

*Mineral oil mixed with sodium sulfonate at 3% in distilled water = 100%. (See Table 4)

We claim:

1. An emulsifiable composition comprising:

(a) an ester formed by reacting an alkenylsuccinic anhydride or acid, wherein the alkenyl is derived from a mixture of $C_{16}$–$C_{28}$ olefins, with (1) a hydroxy-containing tertiary alkylamine containing 2 to 100 carbon atoms or (2) a hydroxypolyetheramine of the formula $$R-\underset{\underset{R'}{|}}{N}-(CH_2CH_2O)_xCH_2CH_2OH \quad \text{or}$$

$$R-\underset{\underset{R'}{|}}{N}-(CH_2CH_2CH_2O)_xCH_2CH_2CH_2OH$$

wherein R is a $C_8$ to $C_{18}$ hydrocarbyl group, R′ is selected from the group consisting of R and a polyether group derived from 1–50 moles of ethylene oxide or propylene oxide, and x is 1 to 50, (b) the product of (a) (2) and a rosin soap, or (c) the product of (a) or (b) and from about 0.5% to about 15.0% by weight of a $C_2$–$C_{10}$ monocarboxylic acid, the reaction to form said ester being carried out at from about 100° C. to about 300° C.

2. The composition of claim 1 wherein the alkylamine is triethanolamine.

3. The composition of claim 1 wherein the polyether amine is a polyoxyethylene soyamine.

4. The composition of claim 3 wherein the amine is a $C_{16}$ to $C_{18}$ primary amine reacted with 5 moles of ethylene oxide.

5. The composition of claim 1 wherein the rosin soap is the potassium salt of rosin acid.

6. The composition of claim 5 wherein the rosin acid is predominantly abietic acid.

7. The composition of claim 1 wherein the mixture of olefins fall within Table 1 of the specification.

8. The composition of claim 1 wherein the monocarboxylic acid is acetic acid.

9. The composition of claim 1 wherein the monocarboxylic acid is caprylic acid.

10. The composition of claim 1 wherein the monocarboxylic acid is 2-ethylhexanoic acid.

11. A method of metal working comprising using as the metal working lubricant an oil-in-water emulsion containing from about 1 to about 50% of an emulsifiable concentrate comprising:

(a) an ester formed by reacting an alkenylsuccinic anhydride or acid, wherein the alkenyl is derived from a mixture of $C_{16}$–$C_{28}$ olefins, with (1) a hydroxy-containing tertiary alkylamine containing 2 to 100 carbon atoms or (2) a hydroxypolyetheramine of the formula $$R-\underset{\underset{R'}{|}}{N}-(CH_2CH_2O)_xCH_2CH_2OH \quad \text{or}$$

$$R-\underset{\underset{R'}{|}}{N}-(CH_2CH_2CH_2O)_xCH_2CH_2CH_2OH$$

wherein R is a $C_8$ to $C_{18}$ hydrocarbyl group, R′ is selected from the group consisting of R and a polyether group derived from 1–50 moles of ethylene oxide or propylene oxide, and x is 1 to 50, (b) the product of (a) (2) and a rosin soap, or (c) the product of (a) or (b) and from about 0.5% to about 15.0% by weight of a $C_2$–$C_{10}$ monocarboxylic acid, the reaction to from said ester being carried out at from about 100° C. to about 300° C.

12. The method of claim 11 wherein the alkylamine used is triethanolamine.

13. The method of claim 11 wherein the polyetheramine is a polyoxyethylene soyamine.

14. The method of claim 13 wherein the amine is a $C_{16}$ to $C_{18}$ primary amine reacted with 5 moles of ethylene oxide.

15. The composition of claim 11 wherein the mixture of olefins falls within Table 1 of the specification.

16. The method of claim 11 wherein the monocarboxylic acid is acetic acid.

17. The method of claim 11 wherein the monocarboxylic acid is caprylic acid.

18. The method of claim 11 wherein the monocarboxylic acid is 2-ethylhexanoic acid.

19. A method of metal can forming comprising using as the can forming lubricant an oil-in-water emulsion containing from about 3 to about 20% of an emulsifiable concentrate comprising:

(a) an ester formed by reacting an alkenylsuccinic anhydride or acid, wherein the alkenyl is derived from a mixture of $C_{16}$–$C_{28}$ olefins, with (1) a hydroxy-containing tertiary alkylamine containing 2 to 100 carbon atoms or (2) a hydroxypolyetheramine of the formula $$R-\underset{\underset{R'}{|}}{N}-(CH_2CH_2O)_xCH_2CH_2OH \quad \text{or}$$

$$R-\underset{\underset{R'}{|}}{N}-(CH_2CH_2CH_2O)_xCH_2CH_2CH_2OH$$

wherein R is a $C_8$ to $C_{18}$ hydrocarbyl group, R′ is selected from the group consisting of R and a polyether group derived from 1–50 moles of ethylene oxide or propylene oxide, and x is 1 to 50, (b) the product of (a) (2) and a rosin soap, or (c) the product of (a) or (b) and from about 0.5% to about 15.0% by weight of a $C_2$–$C_{10}$ monocarboxylic acid, the reaction to form said ester being carried out at from about 100° C. to about 300° C.

20. The method of claim 19 wherein the alkylamine used is triethanolamine.

21. The method of claim 19 wherein the polyetheramine is a polyoxyethylene soyamine.

22. The method of claim 21 wherein the amine is a $C_{16}$ to $C_{18}$ primary amine reacted with 5 moles of ethylene oxide.

23. The method of claim 19 wherein the mixture of olefins falls within Table 1 of the specification.

* * * * *